United States Patent [19]

Chandhok et al.

[11] Patent Number: 4,881,984

[45] Date of Patent: Nov. 21, 1989

[54] CONSOLIDATION OF MAGNET ALLOY POWDERS BY EXTRUSION AND PRODUCT THEREFROM

[75] Inventors: Vijay K. Chandhok; Bao-Min Ma, both of Pittsburgh, Pa.

[73] Assignee: Crucible Materials Corporation, Pittsburgh, Pa.

[21] Appl. No.: 159,455

[22] Filed: Feb. 18, 1988

Related U.S. Application Data

[63] Continuation of Ser. No. 889,760, Jul. 28, 1986, abandoned.

[51] Int. Cl.[4] ..... H01F 1/02

[52] U.S. Cl. ..... 148/101; 148/104; 419/12; 419/41; 419/67; 72/253.1; 72/700

[58] Field of Search ..... 148/104, 101; 419/67, 419/12, 41; 72/253.1, 700

[56] References Cited

FOREIGN PATENT DOCUMENTS 0133758 3/1985 European Pat. Off. .
0187538 7/1986 European Pat. Off. .

OTHER PUBLICATIONS

Metal Handbook, 9th ed., vol. 7, 1984, pp. 515 to 518.

*Primary Examiner*—John P. Sheehan
*Attorney, Agent, or Firm*—Finnegan, Henderson, Farabow, Garrett & Dunner

[57] ABSTRACT

A method for producing a fully dense permanent magnet article by placing a particle charge of the desired permanent magnet alloy in a container, sealing the container, heating the container and charge and extruding to achieve a magnet having mechanical anisotropic crystal alignment and full density.

2 Claims, 1 Drawing Sheet

CONSOLIDATION OF MAGNET ALLOY POWDERS BY EXTRUSION AND PRODUCT THEREFROM

This application is a continuation of application Ser. No. 889,760, filed July 28, 1986 abandoned.

BACKGROUND OF THE INVENTION

For various permanent magnet applications, it is known to produce a fully dense rod or bar of a permanent magnet alloy, which is then divided and otherwise fabricated into the desired magnet configuration. It is also known to produce a product of this character by the use magnet particles, which may be prealloyed particles of the desired permanent magnet composition. The particles are produced for example by either casting and comminution of a solid article or gas atomization of a molten alloy. Gas atomized particles are typically comminuted to achieve very fine particle sizes. Ideally the particle sizes should be such that each particle constitutes a single crystal domain. The comminuted particles are consolidated into the essentially fully dense article by die pressing or isostatic pressing followed by high-temperature sintering. To achieve the desired magnetic anisotrophy, the crystal particles are subjected to alignment in a magnetic field prior to the consolidation step.

In permanent magnet alloys, the crystals generally have a direction of optimum magnetization and thus optimum magnetic force. Consequently, during alignment the crystals are oriented in the direction that provides optimum magnetic force in a direction desired for the intended use of the magnet. To provide a magnet having optimum magnetic properties, therefore, magnetic anisotrophy is achieved with the crystals oriented with their direction of optimum magnetization in the desired and selected direction.

This conventional practice is used to produce rare-earth element containing magnet alloys and specifically alloys of neodymium-iron-boron. The conventional practices used for this purpose suffer from various disadvantages. Specifically, during the comminution of the atomized particles large amounts of cold work are introduced that produce crystal defects and oxidation results which lowers the effective rare-earth element content of the alloy. Consequently, rare-earth additions must be used in the melt from which the cast or atomized particles are to be produced or in the powder mixture prior to sintering in an amount in excess of that desired in the final product to compensate for oxidation. Also, the practice is expensive due to the complex and multiple operations prior to and including consolidation, which operations include comminuting, aligning and sintering. The equipment required for this purpose is expensive both from the standpoint of construction and operation.

Permanent magnets made by these practices are known for use with various types of electric motors, holding devices and transducers, including loudspeakers and microphones. For many of these applications, the permanent magnets have a circular cross section constituting a plurality of arc segments comprising a circular permanent magnet assembly. Other cross-sectional shapes, including square, pentagonal and the like may also be used. With magnet assemblies of this type, and particularly those having a circular cross section, the magnet is typically characterized by anisotropic crystal alignment.

During mechanical working the crystals will tend to orient in the direction of easiest crystal flow. This results in mechanical, crystal anisotrophy. The preferred orientation from the standpoint of optimum directional magnetic properties is desirably established in the optimum crystal magnetization direction by this mechanical crystal anisotrophy.

OBJECTS OF THE INVENTION

It is accordingly a primary object of the present invention to provide a method for producing fully dense, permanent magnet alloy articles having mechanical anisotropic crystal alignment by an efficient, low-cost practice.

An additional object of the invention is to provide a method for producing permanent magnet articles of this type wherein cold work resulting from comminution and oxidation of the magnet particles with attendant excessive loss in effective alloying elements, such as rare-earth elements, including neodymium, may be avoided.

A further object of the invention is to provide a method for producing permanent magnet alloy articles of this type wherein the steps of comminution of the atomized particles and alignment in a magnetic field may be eliminated from the production practice to correspondingly decrease production costs.

Another object of the invention is to produce a permanent magnet characterized by anisotropic radial crystal alignment.

SUMMARY OF THE INVENTION

Broadly, the method of the invention provides for the production of a fully dense permanent magnet alloy article by producing a particle charge of a permanent magnet alloy composition from which the article is to be made. The charge is placed in a container and the container is evacuated, sealed and heated to elevated temperature. It is then extruded to achieve mechanical anisotropic crystal alignment and to compact the charge to full density to produce the desired fully dense article. The particle charge may comprise prealloyed, as gas atomized particles. Extrusion may be conducted at a temperature within the range of 1400 to 2000 F.

The permanent magnet article of the invention may be characterized by mechanical anisotropic crystal alignment which may be radial. The magnet article preferably has an arcuate peripheral surface and an arcuate inner surface and is characterized by mechanical anisotropic radial crystal alignment and corresponding anisotropic radial magnetic alignment. The magnet article may have a circular peripheral surface and an axial opening defining a circular inner surface. Also the magnet article may include an arc segment having an arcuate peripheral surface and a generally coaxial arcuate inner surface. The alloy of the magnet may comprise neodynium-iron-boron.

In accordance with the invention, mechanical radial alignment of the extruded magnet results in the crystals being aligned for optimum magnetic properties in the radial direction rather than axially. In a cylindrical magnet, during magnetization if the center or axis is open, one pole is on the inner surface and the other is on the outer surface in a radial pattern of magnetization. With the magnet of the invention the crystal alignment and magnetic poles may extend radially. Therefore, the magnetic field is uniform around the entire perimeter of the magnet.

DETAILED DESCRIPTION OF THE PREFERRED EMBODIMENTS

By the use of as atomized powder and specifically as gas atomized power, comminution is avoided to accordingly avoid additional or excessive oxidation and loss of alloying elements, such as neodymium, and to eliminate cold working or deformation that introduces crystal defects. With the extrusion practice in accordance with the invention the desired mechanical radial anisotropic crystal alignment is achieved by the extrusion practice without requiring particle sizes finer than achieved in the as atomized state and without the use of a magnetizing field from a high cost magnetizing source. Consequently with the extrusion practice in accordance with the invention both consolidation to achieve the desired full density and anisotropic crystal alignment is achieved by one operation, thereby eliminating the conventional practice of aligning in a magnetic field prior to consolidation. The crystal alignment may be radial as well as anisotropic for magnet articles having arcuate or circular structure.

Figure 1:
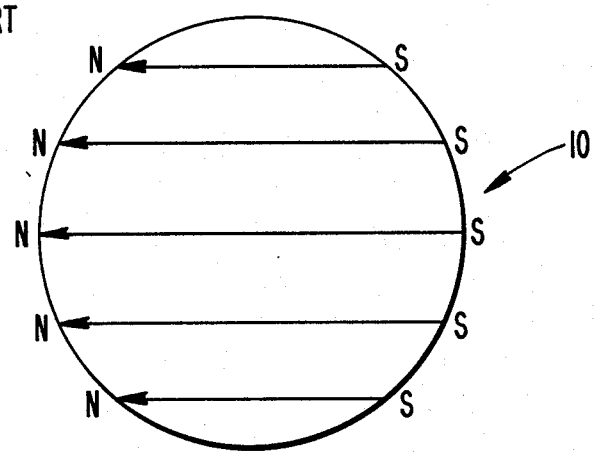
FIG. 1 PRIOR ART
FIG. 1 is a schematic showing of an anisotropic, transverse aligned and anisotropic, transverse magnetized magnet article in accordance with prior art practice.
Figure 2:
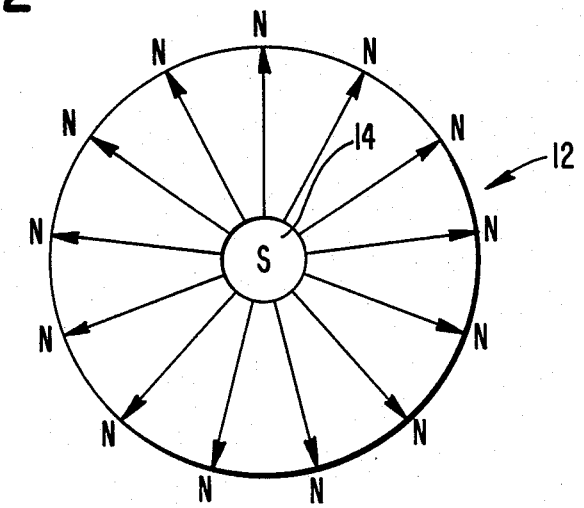
FIG. 2 is a schematic showing of one embodiment of an anisotropic, radial aligned and anisotropic, radial magnetized magnet article in accordance with the invention.
Figure 3:
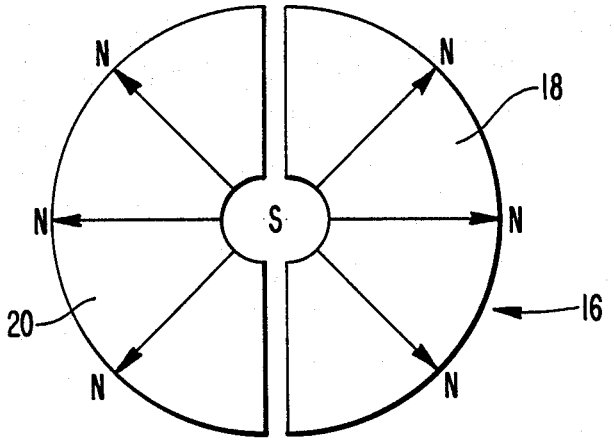
FIG. 3 is a schematic showing of an additional embodiment of an anisotropic, radial aligned and anisotropic, radial magnetized arc-section articles constituting a magnet assembly in accordance with the invention.

With reference to the drawings, FIG. 1 shows a prior art circular magnet, designated as 10, that is axially aligned and magnetized with the arrows indicating the alignment and magnetized direction, and N and S indicating the north and south poles, respectively. Because of the axial alignment, the magnetic field produced by this magnet would not be uniform about the periphery thereof. FIG. 2 shows a magnet, designated as 12, having a center opening 14. By having the magnet radially aligned and radially magnetized in accordance with the invention, as indicated by the arrows, the magnetic field produced by this magnet will be uniform about the periphery of the magnet. FIG. 3 shows a magnet assembly, designated as 16, having two identical arc segments 18 and 20. As may be seen from the direction of the arrows, the magnet segments 18 and 20 are radially aligned and magnetized in a like manner to the magnet shown in FIG. 2. This magnet would also produce a magnetic field that is uniform about the periphery of the magnet assembly.

As will be demonstrated hereinafter, the extrusion temperature is significant. If the temperature is too high such will cause undue crystal growth to impair the magnetic properties of the magnet alloy article, specifically energy product. If, on the other hand, the extrusion temperature is too low effective extrusion both from the standpoint of consolidation to achieve full density and mechanical anisotropic crystal alignment will not be achieved.

SPECIFIC EXAMPLES

Particle charges of the following permanent alloy compositions were prepared for use in producing magnet samples for testing. All of the samples were of the permanent magnet alloy 33Ne, 66Fe, 1B, in weight percent, which was gas atomized by the use of argon to produce the particle charges. The alloy is designated as 45H. Particle charges were placed in steel cylindrical containers and extruded to full density to produce magnets.

TABLE I

Magnetic Properties of Extruded magnets.
Material: Alloy 45H −10 mesh powder

| Die Size Inch | Extrusion Temperature °F. | Measuring Direction (as extruded) | Br Gauss | Hc Oe | Hci Oe | BHmax MGOe | Hk Oe |
|---|---|---|---|---|---|---|---|
| 0.75 | 1600 | axial | 4100 | 3200 | 8400 | 3.2 | 1550 |
| | | radial 1 | 7800 | 5900 | 9300 | 12.4 | 3400 |
| | | radial 2 | 7800 | 6900 | 9350 | 12.8 | 3500 |
| 0.75 | 1700 | axial | 3920 | 3000 | 8730 | 3.0 | 1400 |
| | | radial 1 | 7600 | 5380 | 8800 | 11.1 | 2650 |
| | | radial 2 | 7600 | 5380 | 8620 | 11.6 | 2800 |
| 0.75 | 1800 | axial | 3700 | 2800 | 8150 | 2.7 | 1400 |
| | | radial 1 | 7580 | 5100 | 8000 | 11.2 | 2450 |
| | | radial 2 | 7100* | 4850* | 8000 | 9.4* | 2400 |
| 0.75 | 1900 | axial | 3500 | 2400 | 5650 | 2.3 | 1000 |
| | | radial 1 | 6800 | 4420 | 6400 | 8.8 | 2200 |
| | | radial 2 | 6700 | 4350 | 6350 | 8.6 | 1900 |
| 0.625 | 1900 | axial | 3800 | 2800 | 7000 | 2.6 | 1150 |
| | | radial 1 | 7150 | 4450 | 6700 | 9.2 | 2050 |
| | | radial 2 | 7200 | 4450 | 7670 | 9.4 | 2100 |
| 0.75 | 2000 | axial | 3900 | 2800 | 6700 | 2.9 | 1100 |
| | | radial 1 | 6800 | 4880 | 5900 | 7.6 | 1500 |
| | | radial 2 | 7000 | 4000 | 6100 | 8.0 | 1700 |
| **0.75 | 1900 | axial | 4350 | 2150 | 10650 | 3.4 | 1300 |
| | | radial 1 | 6000 | 4100 | 10600 | 6.3 | 1650 |
| | | radial 2 | 6200 | 4200 | 10250 | 6.8 | 1600 |
| **0.75 | 2000 | axial | 1500 | 800 | 1900 | 0.3 | 200 |
| | | radial 1 | 5500 | 3000 | 7400 | 4.0 | 700 |
| | | radial 2 | 5000 | 2800 | 7300 | 3.4 | 700 |

*Sample chipped
**As-cast 30B alloy extruded at 2000 F.

The samples were extruded over the temperature range of 1600–2000 F.

As may be seen from the data presented in Table I, remanence (Br) and energy product ($BH_{max}$) are affected by the extrusion temperature. Specifically, the lower extrusion temperatures produced improved remanence and energy product values. At each temperature a drastic improvement in these properties was achieved with radial alignment, as opposed to axial alignment. This is believed to result from the fact that recrystalization is minimized during extrusion at these lower temperatures. Consequently, during subsequent annealing crystal size may be completely controlled to achieve optimum magnetic properties.

| Compaction Temp. (°F.) | Measuring Direction | Br Gauss | Hc Oe | Hci Oe | BHmax MGOe | Hk Oe | density gm/cc |
|---|---|---|---|---|---|---|---|
| 1550 | axial | 5800 | 2820 | 4300 | 4.8 | 950 | 7.52 |
| | radial | 5380 | 2800 | 4400 | 4.2 | 860 | |
| | radial | 5250 | 2700 | 4350 | 3.9 | 750 | |
| 1500 | axial | 6050 | 3350 | 5350 | 5.9 | 1050 | 7.52 |
| | radial | 5600 | 3200 | 5450 | 5.2 | 1050 | |
| | radial | 5500 | 3150 | 5400 | 5.0 | 1100 | |

Table II reports magnetic properties for magnets of the same composition as tested and reported in Table I, except that the magnets were not extruded but were produced by hot pressing. The magnetic properties were inferior to the properties reported in Table I for extruded magnets.

TABLE III

Magnetic Properties of Extruded Magnets Measured along Radial Directions.

| Magnet | Powder mesh | Die inch | Temperatures °F. | Br gauss | Hc Oe | Hci Oe | BHmax MGOe | Hk Oe |
|---|---|---|---|---|---|---|---|---|
| EX-34A | −10 | 0.875 | 1550 | 7900 | 5400 | 7800 | 12.4 | 2950 |
| | | | | 7700 | 5400 | 7780 | 12.0 | 3000 |
| EX-34B | −10 | 0.875 | 1550 | 7500 | 5200 | 7520 | 11.0 | 2800 |
| | | | | 7600 | 5300 | 7600 | 11.6 | 3000 |
| EX-33A | −10 | 1.00 | 1550 | 7220 | 5000 | 7400 | 10.4 | 2650 |
| | | | | 7200 | 4900 | 7300 | 10.0 | 2700 |
| EX-33B | −10 | 1.00 | 1550 | 6900 | 4700 | 7200 | 9.0 | 2350 |
| | | " | " | 6900 | 4700 | 7300 | 9.2 | 2400 |
| | | | | 8200 | 5100 | 7350 | 12.0 | 2350 |
| EX-10 | −10 | 0.75 | 1600 | 7700 | 5750 | 8800 | 12.3 | 3400 |
| | | | | 7620 | 5700 | 8750 | 12.0 | 3400 |
| EX-36A | −10 +60 | 0.875 | 1600 | 7600 | 5100 | 7680 | 10.9 | 2800 |
| | | | | 7480 | 5050 | 7650 | 10.4 | 2400 |
| EX-36B | −10 +60 | 0.875 | 1600 | 7500 | 5080 | 7700 | 10.8 | 2550 |
| | | | | 7500 | 5100 | 7800 | 10.7 | 2650 |
| EX-37A | −10 +60 | 0.875 | 1600 | 7550 | 4800 | 7000 | 10.6 | 2450 |
| | | | | 7500 | 4860 | 7030 | 10.4 | 2450 |
| EX-38A | −60 +120 | 0.875 | 1600 | 7680 | 5040 | 7200 | 11.0 | 2550 |
| | | | | 7600 | 5000 | 7100 | 11.2 | 2650 |
| EX-38B | −60 +120 | 0.875 | 1600 | 7700 | 5200 | 7500 | 11.7 | 2720 |
| | | | | 7800 | 5220 | 7500 | 12.0 | 2650 |
| EX-39B | −60 +120 | 0.875 | 1600 | 7500 | 5150 | 7900 | 10.6 | 2600 |
| | | | | 7700 | 5280 | 7800 | 11.6 | 2750 |
| EX-40 | −120 +325 | 0.875 | 1600 | 7350 | 4700 | 6630 | 10.1 | 2210 |
| | | | | — | — | — | — | — |
| EX-42B | −325 | 0.875 | 1600 | 7900 | 5880 | 8500 | 12.9 | 3600 |
| | | | | 7900 | 5800 | 8300 | 13.0 | 3600 |
| EX-30 | −10 | 1.00 | 1600 | 7300 | 5200 | 7900 | 10.7 | 3100 |

It may be seen from the data reported in Table III that the magnetic properties of the extruded samples are not affected by particle size over the size range tested and reported in Table III.

TABLE IV

Magnetic Properties of Extruded Magnets Measured in Radial Directions after Various Heat Treatments.

Alloy 45H, −10 +60 mesh
Extrusion Temperature: 1600° F.
Die Opening(inch)/Angle(degree): 0.875/50

| Samples | Heat Treatment °C.-hours | Br gauss | Hc Oe | Hci Oe | BHmax MGOe | Hk Oe |
|---|---|---|---|---|---|---|
| EX-36A | as-extruded | 7600 | 5100 | 7680 | 10.9 | 2800 |
| | | 7480 | 5050 | 7650 | 10.4 | 2400 |
| " | 550-1 | 7500 | 5250 | 8150 | 10.8 | 2750 |
| | | 7700 | 5280 | 8000 | 11.6 | 2730 |
| " | 550-3 | 7600 | 5200 | 7920 | 11.2 | 2650 |
| | | 7500 | 5200 | 7820 | 10.8 | 2750 |
| " | 550-6 | 7600 | 5200 | 7850 | 11.2 | 2550 |
| | | 7550 | 5200 | 7800 | 11.2 | 2650 |
| " | 1060-3 | 7800 | 5750 | 8500 | 12.6 | 3600 |
| | | 7800 | 5700 | 8400 | 12.6 | 3600 |
| " | 1000-3 | 7800 | 5500 | 8000 | 12.4 | 3200 |
| | | 7620 | 5400 | 7900 | 11.6 | 3250 |
| " | 1010-3 | 7800 | 5450 | 7900 | 12.2 | 3300 |
| | | 7750 | 5400 | 7850 | 12.0 | 3200 |
| " | 1035-12 | 7680 | 5500 | 7650 | 12.0 | 3200 |
| | | 7650 | 5400 | 7650 | 12.0 | 3300 |
| EX-36B | as-extruded | 7500 | 5080 | 7700 | 10.8 | 250 |
| | | 7500 | 5100 | 7800 | 10.7 | 2650 |
| " | 800-2 | 7680 | 5700 | 9000 | 12.0 | 3300 |
| | | 7640 | 5650 | 8900 | 12.0 | 3350 |
| " | 900-3 | 7700 | 5850 | 9120 | 12.4 | 3650 |
| | | 7400 | 5600 | 9000 | 11.0 | 3450 |
| " | 1060-3 | 7600 | 5600 | 8300 | 12.0 | 3400 |
| | | 7700 | 5600 | 8320 | 12.0 | 3350 |

Table IV shows the effect of heat treatment after extrusion on the magnetic properties. It appears from this data that at a heat-treating temperature of 800 C. or above both remanence and energy product are improved.

TABLE V

Magnetic properties of Extruded Magnets in the As-Extruded and Die-upsetted condition Sample: EX-10, Alloy 45H, −10 mesh
Extrusion Temperature: 1600 ° F.
Die Opening(inch)/ Angle(degree): 0.75/50

| Conditions | Direction | Br gauss | Hc Oe | Hci Oe | BHmax MGOe | Hk Oe |
|---|---|---|---|---|---|---|
| as-extruded | axial | 4100 | 3200 | 8400 | 3.2 | 1550 |
| | radial | 7800 | 5900 | 9300 | 12.4 | 3400 |
| | radial | 7800 | 6900 | 9350 | 12.8 | 3500 |
| Die-Upsetted | axial | 6800 | 5700 | 8600 | 8.2 | 1750 |
| | radial | 4900 | 3450 | 8340 | 4.4 | 1350 |
| | radial | 5300 | 3650 | 7300 | 4.9 | 1450 |

An extruded sample magnet (sample EX-10) was tested to determine magnetic properties in the as extruded condition. The sample was then die upset forged and again tested to determine magnetic properties. The data presented in Table V indicates the significance of the "radial properties" achieved as a result of the extrusion operation in accordance with the practice of the invention.

We claim:

1. A method for producing a fully dense, arcuate or cylindrical permanent magnet alloy article, said method comprising producing by gas atomization a particle charge of a permament magnet alloy composition comprising a rare earth element, iron and boron from which said article is to be made, in the absence of comminution and magnetic alignment of said particles placing said particle charge in a container, evacuating and sealing said container, heating said container and said particle charge to an elevated temperature and extruding said container and particle charge at a temperature of 1400° to 2000° F. to achieve mechanical anisotropic radial crystal alignment and corresponding anisotropic radial magnetic alignment and to compact said charge to full density to produce said fully dense article.

2. The method of claim 1 wherein said particle charge comprises a neodymium-iron-boron alloy.

* * * * *